US005435545A

United States Patent [19]

Marotta

[11] Patent Number: 5,435,545

[45] Date of Patent: Jul. 25, 1995

[54] STRIKE ZONE TRAINER FOR HITTING A BASEBALL

[76] Inventor: Sam A. Marotta, 196 Creekside Dr., Plainfield, Ill. 60544

[21] Appl. No.: 123,669

[22] Filed: Sep. 20, 1993

[51] Int. Cl.[6] ..... A63B 69/40

[52] U.S. Cl. ..... 273/26 R

[58] Field of Search ..... 273/26 R, 26 A, 29 A

[56] References Cited

U.S. PATENT DOCUMENTS

| | | | |
|---|---|---|---|
| D. 246,123 | 10/1977 | Scoggins | 273/26 R |
| 2,964,316 | 12/1960 | Rose | 273/26 R |
| 3,312,467 | 4/1967 | Dawson | 273/26 A |
| 3,940,131 | 2/1976 | Claire, Jr. | 273/26 R |
| 4,295,648 | 10/1981 | Stromback | 273/26 A |
| 4,473,227 | 9/1984 | Klaus | 273/26 A |
| 4,783,070 | 11/1988 | Bauer | 273/26 R |
| 5,071,122 | 10/1991 | Messina | 273/26 R |
| 5,087,039 | 2/1992 | Laseke | 273/26 R |

FOREIGN PATENT DOCUMENTS

| | | | |
|---|---|---|---|
| 1136171 | 11/1982 | Canada | 273/26 R |

*Primary Examiner*—Theatrice Brown
*Attorney, Agent, or Firm*—Ernest Kettelson

[57] ABSTRACT

A trainer for hitting a baseball comprises a cylindrical pole extending upwardly from a base member placed in front of home plate and toward the half opposite from where the batter using the trainer stands so the upright cylindrical pole is substantially in line with the outside edge of home plate, a lower strike zone indicating shaft extends laterally from the pole at the level of the lower edge of the strike zone upper strike zone indicating shaft extends laterally from the pole at the level of the upper edge of the strike zone, and a ball positioning shaft with a ball tee at one end and a simulated baseball at its opposite end extends laterally from the pole at any selected level between the upper and lower strike zone indicating shafts. The ball positioning shaft is slidably mounted on a rotatable swivel block whereby it can rotate about the pole to position either the ball tee at one end or simulated baseball at the opposite end at any selected position between the inner and outer edges of the strike zone. The outer end of the lower strike zone indicating shaft terminates in line with the inner edge of the strike zone. The outer end of the upper strike zone indicating shaft terminates in line with the longitudinal mid-line of home plate.

19 Claims, 4 Drawing Sheets

STRIKE ZONE TRAINER FOR HITTING A BASEBALL

BACKGROUND OF THE INVENTION

This invention relates to a training device to help train athletes how to swing at and hit a baseball properly and to improve their hitting ability.

Prior art devices in this general category of which the inventor is aware include those described in the following patents.

U.S. Pat. No. 5,076,580 discloses a foot positioning apparatus for batting practice comprising a vertical pole extending upwardly from the center of home plate serving as a tee to hold a baseball thereon in the strike zone, and a laterally extending foot positioner extending from the pole in the center of home plate and pivotal therearound, the foot positioner having telescoping members to move its outer end closer to or farther from home plate, and a foot alignment assembly pivotally secured to the outer end of the telescoping foot positioner.

U.S. Pat. No. 5,071,122 discloses a baseball batting training apparatus comprising a tripod base having a vertically extending pole and three laterally extending arms pivotally mounted on the pole at vertically spaced apart locations within the strike zone, a simulated baseball secured to the end of each arm, a signal light to signal which of the three simulated baseballs is to be swung at and hit, a timer to measure the batter's reaction time between the signal light going on and when he actually strikes the ball, plus a counter to count the revolutions of the hit ball and its rotatable arm around the pole.

U.S. Pat. No. 4,989,866 discloses an adjustable batting tee comprising a short vertical upright member extending up from the center of home plate, a horizontal arm pivotally connected to the short vertical member, its outer end being slidably adjustable inwardly toward and outwardly from the center of home plate, and an upwardly extending baseball tee extending upwardly from the outer end of the horizontal arm and being slidably adjustable up or down. The upwardly extending baseball tee includes a flexible portion to flex when a baseball is hit off the top of the tee. The horizontal arm is pivotable within an arc of about 120 degrees, its pivotal movement being limited by a pair of spaced apart abutment rods to each side of the short vertical upright member and slightly forward thereof.

U.S. Pat. No. 4,886,267 discloses a baseball practice apparatus comprising a tee to position a baseball in the strike zone, and a vertically extending swing guide spaced apart behind the batter in line with home plate at a location within which the bat must be swung if done properly, that is by keeping the batter's rearwardly extending elbow from dropping and to keep the wrists from being prematurely broken in the swing. If the rearwardly positioned swing guide is hit by the bat, the batter's swing was not done properly.

U.S. Pat. No. 4,819,937 discloses a combined batting tee and strike zone indicator comprising a home plate and a laterally extending bar positioned in front of home plate. When used as a tee, a first telescoping upright is placed in the center of the lateral bar and a second telescoping upright is placed in the center of home plate at a height to indicate the level of the bat as it is swung at a baseball placed on top of the first telescoping upright. When used as a strike zone indicator, the telescoping uprights are both placed on the lateral bar in front of home plate and at each side of the plate to show the boundaries of the strike zone. Color bands on the telescoping uprights indicate the high and low range of the strike zone.

U.S. Pat. No. 4,783,070 discloses a target teaching aid comprising an upright pole on a base and two laterally extending arms extending outwardly from the pole in spaced apart relationship to define the upper and lower boundaries of the strike zone when used as a batting trainer. One or more vertically extending ribbons are connected between the laterally extending arms to define the side edges of whatever target the device is used to define. When used to define the strike zone for a batter to swing through, only one vertically extending ribbon can be used, namely to indicate the outside edge of the plate and strike zone.

U.S. Pat. No. 4,664,375 discloses a baseball batting practice device comprising a vertical support shaft having an overhead horizontal bar extending laterally therefrom and a baseball suspended from the horizontal bar on a rope or flexible line within the strike zone in front of home plate. The device includes foot positioning bars for proper placement of the batter's feet.

U.S. Pat. No. 4,516,771 discloses a batting aid to help a batter perfect a level swing, comprising a pair of resiliently mounted tubular arms which are parallel and spaced apart a distance sufficient for the outer portion of a baseball bat to swing through if kept level. If not kept level, the bat will hit one or both of the tubular arms.

Canadian Patent No. 1,136,171 comprises an upright pole positioned to the side of home plate having a pair of parallel vertically spaced apart arms extending laterally from the pole with a baseball tee on the lower arm and a baseball on the tee. Other non-relevant embodiments of the invention are also disclosed in this Canadian patent.

SUMMARY OF THE INVENTION

The present invention provides an improved trainer for hitting a baseball comprising a strike zone indicating assembly which indicates all four parameters of the baseball strike zone, namely the lower edge of the strike zone, the upper edge, the outer edge end and the inner edge. Furthermore, the strike zone indicating assembly is adjustable to readily adjust for the height of whatever batter is going to use the device next.

A lateral lower strike zone indicating shaft and lateral upper strike zone indicating shaft are readily movable up or down to adjust for the height of the batter by merely sliding them on the cylindrical support pole. When the desired levels are reached, the person making the adjustments can simply let go of the laterally extending shafts and they will automatically hold their place on the support pole. The shafts are rotatably secured to the support pole by swivel blocks made of high density polyethylene having longitudinal vertical bores of substantially the same diameter as the cylindrical pole received therethrough to provide a close fit. The cylindrical pole is made of nylon. The close fit of the nylon pole through the longitudinal bores of the high density polyethylene swivel blocks provides enough frictional force to hold one in place relative to the other, yet the surfaces are such that when a modest amount of pressure is applied the swivel blocks and their shafts can be readily made to slide up or down on the pole.

A freely rotatable ball positioning shaft extends laterally from the cylindrical pole between the lower and upper strike zone indicating shafts, having a light weight simulated baseball, made of plastic material and hollow, on one end and a baseball tee on its opposite end on which a baseball can be placed. This ball positioning shaft is rotatably mounted on the cylindrical pole by a freely rotatable swivel block of high density polyethylene which has a laterally extending bore through which the ball positioning shaft extends. It is slidable within this laterally extending bore to be able to position either its ball tee end or its simulated ball end at any desired position between the inside and outside edge of the strike zone and of home plate.

The freely rotatable swivel block of the ball positioning shaft abuts against a ring bearing member on the cylindrical shaft below the freely rotatable swivel block member. The ring bearing member is made of high density polyethylene and has a longitudinal bore of substantially the same diameter as that of the nylon cylindrical pole. The ring bearing member is thereby able to hold its position on the pole wherever it is moved without any set screws or other securing device, yet it is readily movable by applying modest pressure to slide up or down on the pole. Thus the ring bearing member and the freely rotatable swivel block with the ball positioning shaft extending laterally therefrom which is supported by the ring bearing member can be quickly and easily moved to adjust the vertical position of either the ball tee or the simulated ball within the strike zone.

The outer ends of the laterally extending lower and upper strike zone indicating shafts have enlarged eye-catching blocks to catch the peripheral vision of the batter as he swings at the ball within the strike zone. This helps the batter to remember better where the boundaries of the strike zone are.

The outer end of the lower strike zone indicating shaft indicates the inner edge of the strike zone to the batter using the trainer. The upper strike zone indicating shaft is shorter and its outer end indicates the longitudinal center line of the home plate and of the strike zone.

The ball positioning shaft as well as the lower and upper strike zone indicating shafts are preferably made of nylon. The materials of which the trainer in accordance with this invention are made must be durable, light weight for portability, be able to withstand the impact of baseball bats swung at significant rates of speed, and have the characteristics mentioned of being easily slidable on the support pole while also being able to hold whatever position the shafts are moved to without having to first loosen, then tighten set screws, or manipulate other types of special securing devices.

DESCRIPTION OF PREFERRED EMBODIMENT

Figure 1:
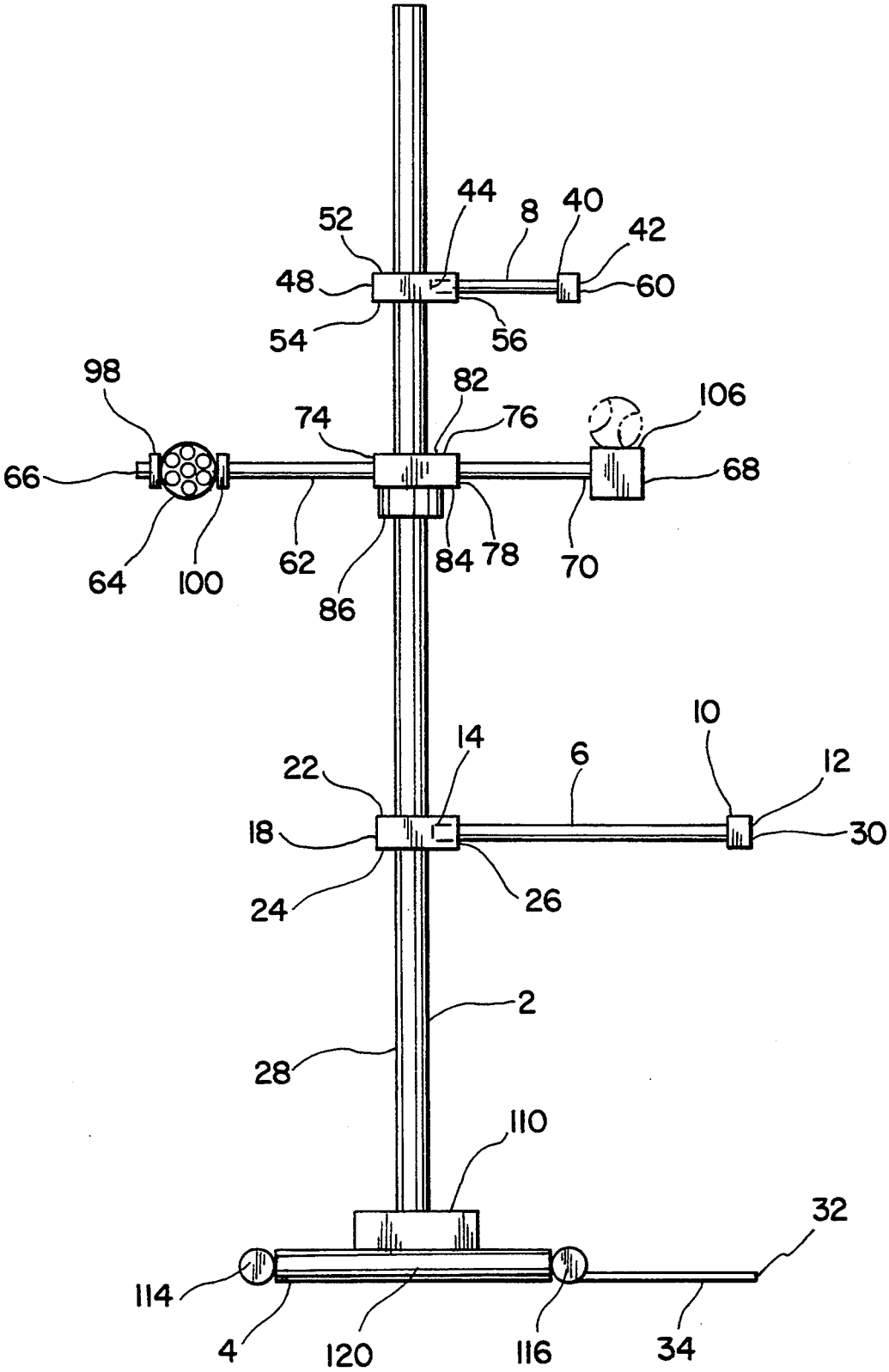
FIG. 1 is an elevation view of the trainer for hitting a baseball in accordance with this invention.
Figure 2:
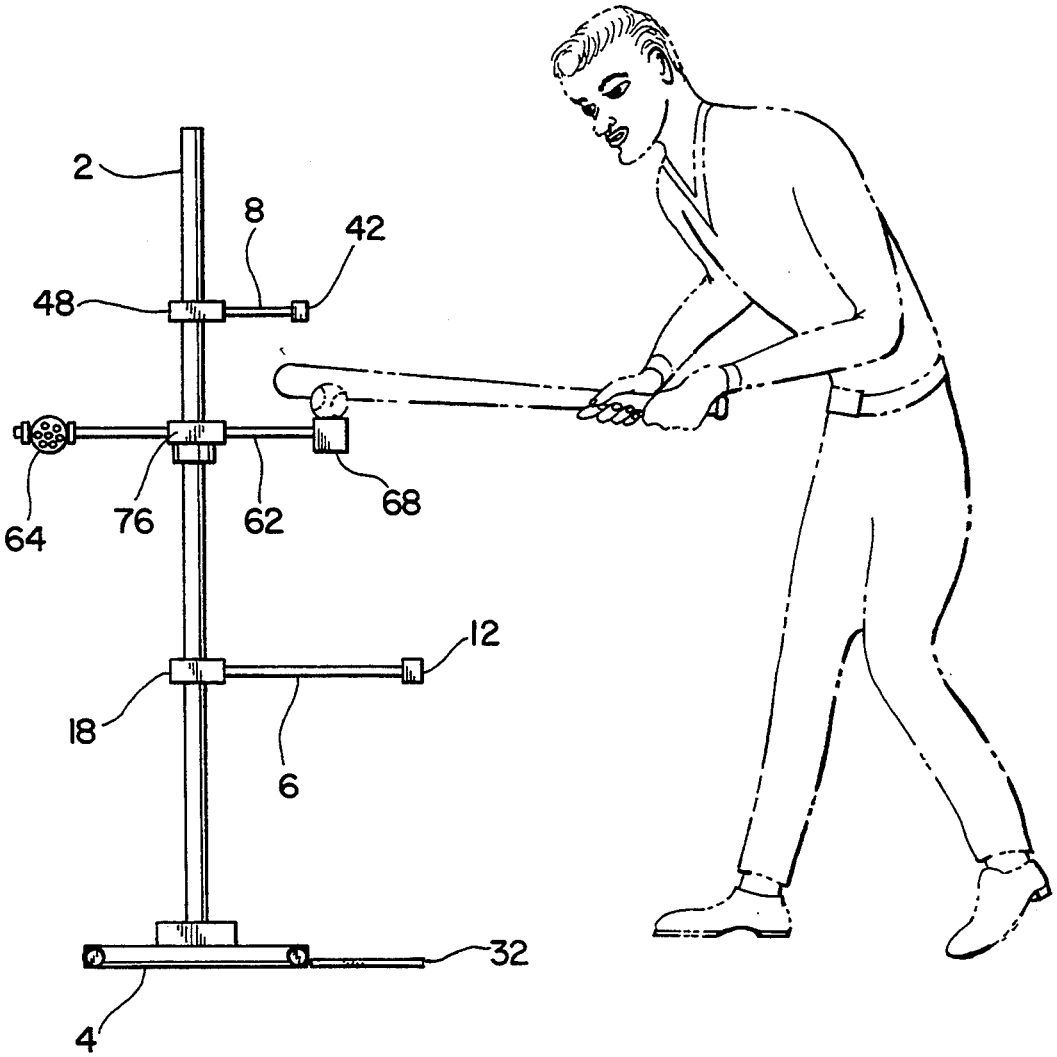
FIG. 2 is an elevation view of the trainer for hitting a baseball as shown in FIG. 1 with a batter in the batter's box shown swinging at a ball placed on the tee within the strike zone.
Figure 3:
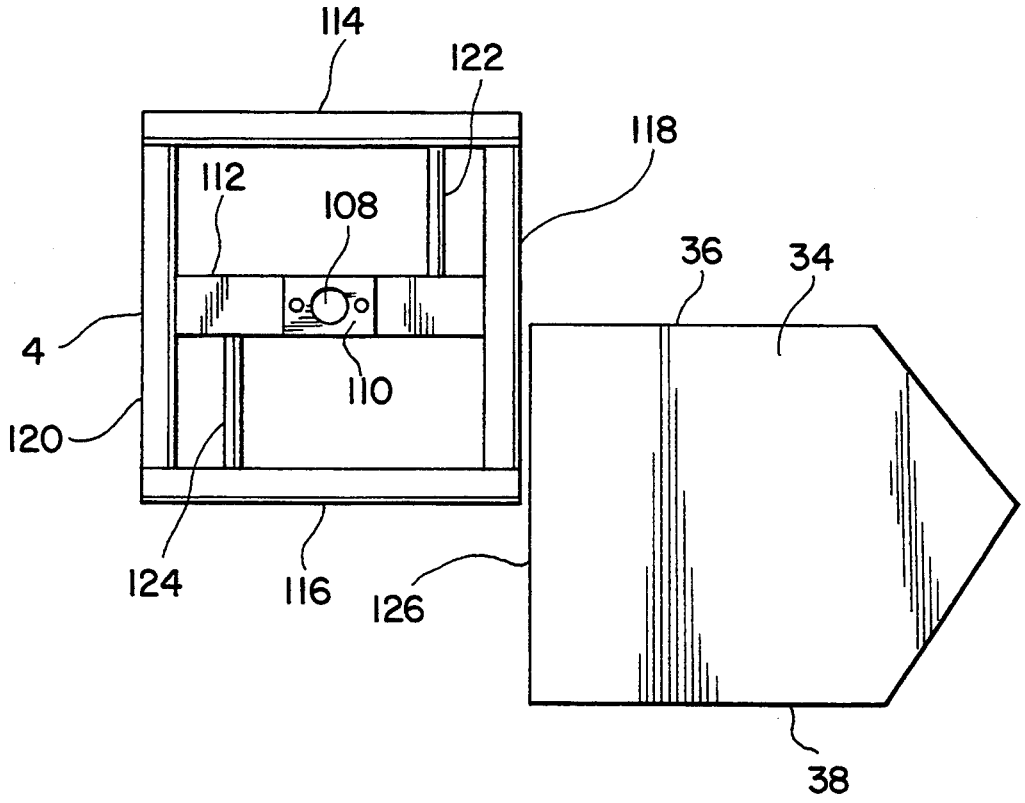
FIG. 3 is a plan view of the base portion of the trainer for hitting a baseball shown in position in front of home plate.
Figure 4:
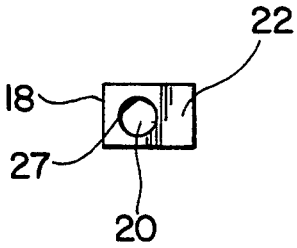
FIG. 4 is a top plan view of the swivel block for the lower strike zone indicating shaft.
Figure 5:
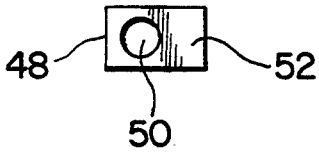
FIG. 5 is a top plan view of the swivel block for the upper strike zone indicating shaft.
Figure 6:
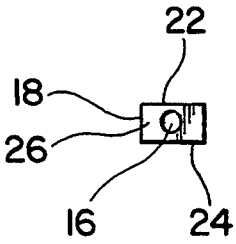
FIG. 6 is an end elevation view of the swivel block for the lower strike zone indicating shaft showing the recess to receive such shaft.
Figure 7:
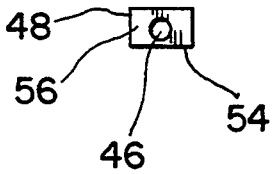
FIG. 7 is an end elevation view of the swivel block for the upper strike zone indicating shaft showing the recess to receive such shaft.
Figure 8:
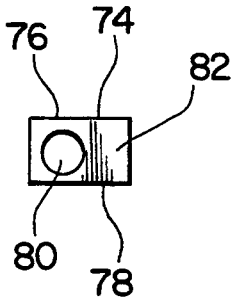
FIG. 8 is a top plan view of the freely rotatable swivel block for the ball positioning shaft.
Figure 9:
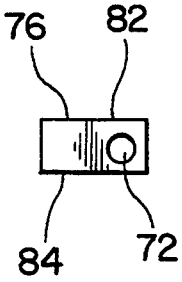
FIG. 9 is an end elevation view of the freely rotatable swivel block for the ball positioning shaft showing the lateral bore extending through the swivel block to slidably receive the ball positioning shaft therethrough.
Figure 10:
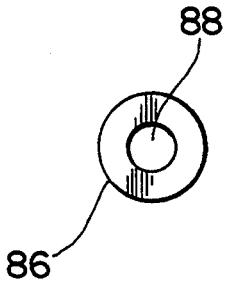
FIG. 10 is a top elevation view of the ring bearing member which supports the freely rotatable swivel block bearing thereagainst.
Figure 11:
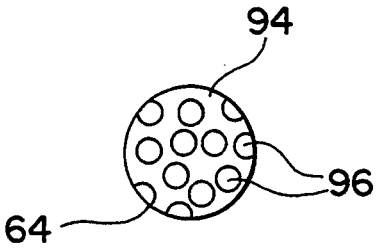
FIG. 11 is an enlarged elevation view of the training ball mounted at one end of the ball positioning shaft.
Figure 12:
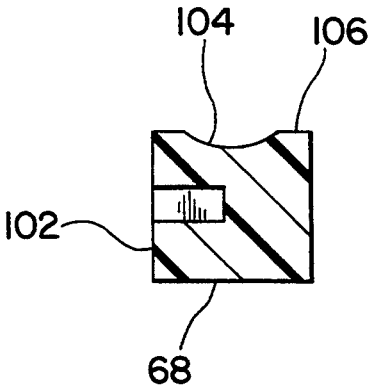
FIG. 12 is a section view of the ball tee mounted at the opposite end of the ball positioning shaft showing the recess to receive the end of such shaft and showing the concave recess in the upwardly facing wall on which to place a baseball for a batter to hit.

A trainer for baseball batters in accordance with the present invention comprises an elongated cylindrical pole 2 extending vertically from a supporting base member 4. A lower strike zone designating shaft 6 extends outward laterally from the cylindrical pole 2 and is positioned vertically above the base member 4 a distance that corresponds with the lower edge of the strike zone in the game of baseball. Its vertical position is adjustable up and down to match the height of the player and what the strike zone would be for a player of any height. The lower edge of the strike zone in baseball is usually at the level of the player's knees.

An upper strike zone designating shaft 8 extends outward laterally from the cylindrical pole 2 and is positioned vertically above the base member 4 a distance that corresponds with the upper edge of the strike zone in the game of baseball. Its vertical position is also adjustable up and down to match the height of the player and what the strike zone would be for a player of any height. The upper edge of the strike zone in baseball is somewhat more subjective than the lower edge, but is somewhere in the mid-region between a player's waist and chest.

The lower strike zone designating shaft 6 includes an outer end 10 on which a slightly enlarged eye-catching block 12 is mounted, having a recess to receive the outer free end of the shaft 6. The inner end 14 of the shaft 6 is received in the recess 16 of a swivel block 18 which is rotatably mounted on the elongated vertical pole 2 at the aforesaid position which corresponds with the lower edge of the strike zone.

The swivel block 18 comprises a rectangular body of high density polyethylene having a cylindrical bore 20 extending through the swivel block 18 from its upwardly facing surface 22 to its downwardly facing surface 24. The recess 16 opens to side wall 26 of the swivel block 18 and extends in a direction normal to the cylindrical bore 20. The diameter of the cylindrical bore 20 corresponds to that of the cylindrical pole 2 for a close fit of the pole 2 in the cylindrical bore 20 when received therethrough. The fit is close enough for frictional forces to hold the swivel block 18 with shaft 6 held therein at any vertical position on the pole 2 to which it is moved without the need for a set screw or any other securing device, yet the fit is loose enough to slide the swivel block 18 up or down on the pole 2 to any desired vertical position.

The cylindrical pole 2 is preferably made of nylon. The high density polyethylene inner cylindrical wall 27 of the cylindrical bore 20 in sliding frictional contact with the nylon outer cylindrical wall 28 of the pole 2 have the desired characteristics which enable the close fit of the pole 2 in the bore 20 of corresponding diameter to both hold the swivel block 18 with shaft 6 therein from sliding relative to the pole 2 when no other force is applied and to permit sliding of the swivel block 18 relative to the pole 2 when a modest force is applied to slide the swivel block 18 on the pole 2.

The pole 2 and bore 20 have a diameter that is preferably about one inch across. The thickness of the swivel block 18, and the longitudinal dimension of the bore 20, between the upwardly facing surface 22 and the downwardly facing surface 24 is preferably also about one inch.

The laterally extending shaft 6 received in the recess 16 of the swivel block 18 tends to put slightly canting pressure on the longitudinal axis of the swivel block 18 and its bore 20 relative to the longitudinal axis of the pole 2, which additionally serves to bind and hold the swivel block 18 in whatever vertical position it is placed on the pole 2 until moved.

The swivel block 18 is readily rotatable on the cylindrical pole 2 when modest pressure is applied in either direction of rotation. However, the close fit of the pole 2 within the cylindrical bore 20 holds the swivel block 18 and the shaft 6 held therein from rotation until such rotational pressure is applied.

The lower strike zone designating shaft 6 extends outwardly from the cylindrical pole 2 a distance which places the outwardly facing surface 30 of the enlarged eye-catching block 12 on its outer end 10 in a vertical plane extending upwardly from the inner longitudinal edge 32 of the home plate 34 alongside of which a batter is standing in position to hit a ball thrown over the plate, when the base member 4 is placed forwardly of the home plate 34 and toward the side which positions the inner end 14 of the shaft 6 on the pole 2 in a vertical plane extending upwardly from the outer longitudinal edge 36 of the home plate 34. The length of the lower strike zone designating shaft 6 is preferably about seventeen inches.

The peripheral vision of the batter using the trainer will catch sight of the eye-catching block 12 as he looks to the point where the ball is to come over the plate thus enabling him to see and learn where the inner edge 32 of the home plate 34 is located, which is also the inner edge of the strike zone.

The upper strike zone designating shaft 8 includes an outer end 40 on which a slightly enlarged eye-catching block 42 is mounted, having a recess to receive the outer free end of the shaft 8. The inner end 44 of the shaft 8 is received in the recess 46 of a swivel block 48 which is rotatably mounted on the elongated vertical pole 2 at the aforesaid position which corresponds with the upper edge of the strike zone.

The swivel block 48 is substantially identical to the swivel block 18 described in detail above. Its cylindrical bore 50 is substantially identical to the cylindrical bore 20 described in detail above. Its upwardly facing surface 52, its downwardly facing surface 54, its side wall 56 to which the recess 46 opens, are substantially identical respectively to the upwardly facing surface 22, the downwardly facing surface 24 and the side wall 26 of the swivel block 18 described in detail above.

The laterally extending shaft 8 received in the recess 46 of the swivel block 48 tends to slightly cant the longitudinal axis of the swivel block 48 and its bore 50 relative to the longitudinal axis of the pole 2, which together with the close fit of the pole 2 in the bore 50 serves to bind and hold the swivel block 48 and shaft 8 therein at whatever vertical position it is placed on the pole 2 until it is moved.

The swivel block 48 is readily rotatable on the cylindrical pole 2 when modest pressure is applied in either direction of rotation. However, the close fit of the pole 2 within the cylindrical bore 50 holds the swivel block 48 and the shaft 8 therein from rotation until such rotational pressure is applied.

The upper strike zone designating shaft 8 extends outwardly from the cylindrical pole 2 a distance which places the outwardly facing surface 60 of the enlarged eye-catching block 42 on its outer end 40 in a vertical plane extending upwardly from the longitudinal mid-line of the home plate 34 when the base member 4 is placed forwardly of the home plate 34 and toward the side which positions the inner end 44 of the shaft 8 on the pole 2 in a vertical plane extending upwardly from the outer longitudinal edge 36 of the home plate 34. The length of the upper strike zone designating shaft 8 is preferably about eight and one-half inches long.

The peripheral vision of the batter using the trainer will catch sight of the eye-catching block 42 as he looks to the point where the ball is to come over the plate thus enabling him to see and learn where the mid-line of the home plate 34 is located, which is also the vertical mid-line of the strike zone.

Between the lower strike zone designating shaft 6 and the upper strike zone designating shaft 8 is a laterally extending ball positioning shaft 62 having a simulated baseball or training ball 64 secured to one end 66 and a support block or ball tee 68 at its opposite end 70. The ball positioning shaft 62 extends substantially normal to the cylindrical pole 2 and is slidable laterally through the lateral bore 72 extending from side wall 74 of a freely rotatable block 76 to its opposite side wall 78. The dimension of the block 76 between the side walls 74 and 78 is about two inches. The diameter of the lateral bore 72 corresponds to the diameter of the ball positioning shaft 62, about one-half inch, for a close but sliding fit whereby the shaft 62 is substantially held in any set position relative to the rotatable block 76 and its lateral bore 72 but is readily slidable through the bore 72 to position the training ball 64 on one end 66 and the ball tee 68 on the opposite end 70 at any selected distance outwardly from the vertical pole 2.

The freely rotatable block 76 has a vertically extending cylindrical bore 80 extending through the block 76 from its upwardly facing surface 82 to its downwardly facing surface 84. The diameter of the cylindrical bore 80 is slightly larger than the diameter of the cylindrical pole 2 to enable the rotatable block 76 to freely rotate when it is mounted on the pole 2 by receiving it through the slightly larger diameter bore 80. To keep the ball positioning shaft 62 and its freely rotatable block 76 at whatever vertical position is selected on the pole 2 between the lower strike zone designating shaft 6 and the upper strike zone designating shaft 8, a cylindrical ring bearing member 86 is provided on the pole 2 for the rotatable block 76 to abut against and rotate on. The ring bearing member 86 comprises an annular body portion having an outer cylindrical side wall and a vertically extending cylindrical bore 88 extending through the body portion from its planar upwardly facing bearing surface 90 to its downwardly facing surface 92.

The diameter of the bore 88 of the ring bearing member 86 corresponds to that of the cylindrical pole 2, each being about one inch in diameter. As stated above, the pole 2 is preferably made of nylon material. The ring bearing member 86 is made of high density polyethylene. The bore 88 receives the pole 2 in a close fit which is close enough for frictional forces of the nylon cylindrical wall of the pole 2 in frictional contact with the high density polyethylene cylindrical wall of the bore 88 to hold the ring bearing member 86 against sliding movement relative to the pole 2 and to support the freely rotatable block 76 with its ball positioning shaft 62, training ball 64 on one end thereof and ball tee 68 on the other end thereof, bearing against the ring bearing member 86.

Nevertheless, the ring bearing member 86 can be slidably moved along the pole 2 to any desired vertical position by applying a relatively modest amount of upward or downward pressure thereon. When a desired vertical position is reached, the ring bearing member 86 will hold that position on the pole 2 without the need for a set screw or any other additional securing device.

The freely rotatable block 76 is also preferably made of high density polyethylene. The ball positioning shaft 62 is preferably made of nylon, as are the lower strike zone designating shaft 6 and the upper strike zone designating shaft 8.

The training ball 64 is a hollow sphere having a thin spherical wall 94 of lightweight rigid plastic material with a plurality of circular apertures 96 therethrough. The ball positioning shaft 62 extends through the training ball 64 at its outer end, and annular collars 98 and 100 against each opposite side of the ball 64 are secured to the shaft 62 by set screws to hold the training ball in place at the end 66 of the shaft 62.

The ball tee 68 comprises a solid block of high density polyethylene material having a recess in side wall 102 to receive the opposite end 70 of the ball positioning shaft 62. A concave recess 104 is formed in the upwardly facing surface 106 of the ball tee 68, having a configuration and dimension corresponding to that of a portion of a baseball to be received in such recess for a batter using the training device to hit.

The lower end of the cylindrical pole 2 is received in a socket 108 of a receiving block 110 of high density polyethylene material positioned on a midline bar 112 of the same material midway between side bars 114 and 116 of the same material of the base 4. The side bars 114 and 116 are connected at their respective opposite ends by end bars 118 and 120 of the same high density polyethylene material. A nylon bracing rod 122 is connected between the midline bar 112 and side bar 114 at a location closer to end bar 118 than to end bar 120. A second nylon bracing rod 124 is connected between the midline bar 112 and side bar 116 at a location closer to end bar 120 than to end bar 118. The bracing rods 122 and 124 increase the stability and structural strength of the base member 4.

The pole 2 may be readily disconnected from the base member 4, and the other parts of the trainer described above may be readily disconnected for storage and portability. They may be readily connected to reassemble the trainer for use.

To use the trainer, the base member 4 is placed in front of the home plate 34 with the end bar 118 of the base member 4 adjacent the forward edge 126 of the home plate 34 and offset outwardly from the side edge 36 of home plate 34 opposite the side edge 32 on which the batter stands. The midline bar 112 of the base member 4 is axially aligned with the side edge 36 of home plate 34 which thereby positions the cylindrical pole 2 at a location which is adjacent a vertical plane extending upwardly from the side edge 36 of home plate 34 on its side outwardly therefrom.

This locates the inner end 14 of the lower strike zone designating shaft 6 and the inner end 44 of the upper strike zone designating shaft 8 at a position which intersects such vertical plane that extends upwardly from the side edge 36 of home plate 34. Thus, the inner ends 14 and 44 of the lower and upper strike zone designating shafts 6 and 8 indicate the outer edge of the strike zone, that is the outer edge of home plate, when the trainer is placed as described above.

The eye-catching block 12 at the outer end 10 of the lower strike zone designating shaft 6 is at such time in position to intersect a vertical plane extending upwardly from the side edge 32 of home plate 34, that is the inner edge of the strike zone with reference to a batter standing on that side of the home plate.

The eye-catching block 42 at the outer end 40 of the upper strike zone indicating shaft 8 is at such time in position to intersect a vertical plane extending upwardly from the longitudinal midline of home plate 34, or the vertical midline of the strike zone.

The lower strike zone designating shaft 6 and its swivel block 18 are adjusted upwardly or downwardly on the pole 2 to the position which designates the lower horizontal edge of the strike zone for the particular batter who will then use the trainer. The lower horizontal edge of the strike zone is usually at the level of the batter's knees.

The upper strike zone designating shaft 8 and its block 48 are next adjusted upwardly or downwardly on the pole 2 to the position which designates the upper horizontal edge of the strike zone for the batter who is to use the trainer. The upper horizontal edge of the strike zone may vary within a range from the level of the batter's waist up to about mid-chest.

The ball positioning shaft 62 may then be moved upwardly or downwardly on the pole 2 between the lower and upper strike zone indicating shafts 6 and 8 at different levels for the batter to swing at and become accustomed to different heights of the ball which are still within the strike zone. The ball positioning shaft 62 and its freely rotatable block 76 are rotated to position either the training ball 64 on one end 66 of the shaft 62 or the ball tee 68 at the other end 70 within the strike zone as defined above. If the tee 68 is positioned in the strike zone, a ball is placed thereon in its concave recess 104 for the batter to swing at and hit.

The ball positioning shaft 62 is then moved laterally by sliding through the lateral bore 72 of the freely rotatable block 76 to place the training ball 64 or tee 68 at whatever lateral positions desired within the strike zone as defined above. The lateral position of the ball 64 or tee 68 may be repeatedly changed within the strike zone as well as their vertical position to give the batter an opportunity to familiarize himself with the various positions a pitched ball may occupy as it crosses home plate and still be within the strike zone.

When the trainer is arranged as described above, the batter with bat in hand swings at the training ball 64 or ball on the tee 68. When the ball is hit, the ball positioning shaft 62 is free to rotate. It may be readily repositioned to place the training ball 64 or ball tee 68 in the same or different part of the strike zone for repeat swings by the batter. The batter's repeated swings may be observed by a batting instructor who can more readily correct any problems for batters using the training device in accordance with this invention. All parts of the strike zone are clearly indicated and the training ball can be quickly repositioned for repeat swings.

The construction which extends the ball positioning shaft 62 laterally from the pole 2 at a substantially ninety degree angle, and which enables the shaft and training ball 64 to rotate freely around the pole 2 when hit, teaches the batter to use a more level swing. When the ball is hit by a level swing of the bat, in a substantially horizontal plane, the shaft and ball will rotate more freely, faster and for a longer period of time and more revolutions than if the ball is hit at an oblique angle. If hit at an oblique angle, the impact will tend to make the rotatable block 76 bind on the pole 2 whereby the shaft and ball will not rotate as freely, nor as fast, nor for as many revolutions.

I claim:

1. A trainer for hitting a baseball, comprising a strike zone indicating assembly including first strike zone indicating means to indicate the lower edge of the strike zone, second strike zone indicating means to indicate the upper edge of the strike zone, third strike zone indicating means to indicate a first side edge of the strike zone, fourth strike zone indicating means to indicate a second opposite side edge of the strike zone, support means to support said strike zone indicating assembly at a location relative to a baseball plate to define the strike zone over said plate, and ball positioning means to position a ball for a batter to swing at and hit anywhere within said strike zone defined by said first, second, third and fourth strike zone indicating means of said strike zone indicating assembly, including unobstructed entrance means along only one of said first and second side edges of said strike zone for a bat when swung to enter said strike zone from said one of said first and second side edges, said unobstructed entrance means extending from said first strike zone indicating means which indicates the lower edge of the strike zone up to said second strike zone indicating means which indicates the upper edge of the strike zone, said third strike zone indicating means which indicates a first side edge of the strike zone and said fourth strike zone indicating means which indicates said second side edge of the strike zone both remaining in place.

2. A trainer for hitting a baseball comprising a strike zone indicating assembly including first strike zone indicating means to indicate the lower edge of the strike zone, second strike zone indicating means to indicate the upper edge of the strike zone, third strike zone indicating means to indicate a first side edge of the strike zone, fourth strike zone indicating means to indicate a second opposite side edge of the strike zone, support means to support said strike zone indicating assembly at a location relative to a baseball plate to define the strike zone over said plate, and ball positioning means to position a ball for a batter to swing at and hit within said strike zone defined by said first, second, third and fourth strike zone indicating means of said strike zone indicating assembly, wherein said ball positioning means includes a vertically extending pole, fully rotatable pivot means on said pole to rotate fully around said pole in a circular path, an elongated ball positioning member extending from said rotatable pivot means in a direction substantially normal to said vertically extending pole, said elongated ball positioning member terminating outwardly from said pole in an outer end, ball supporting means on said outer end to hold and position a ball thereon, said rotatable pivot means including a body portion having a longitudinally extending bore through which said pole extends, said longitudinally extending bore and said pole being coaxial when said elongated ball positioning member is in its position substantially normal to said pole as it and said rotatable pivot means are rotated around said pole after a said ball on said ball supporting means has been hit by a proper level swing of the bat in an arc whose plane is substantially horizontal and normal to the longitudinal axis of said vertically extending pole, said longitudinally extending bore being divertable from its said coaxial relationship to said pole whereby its longitudinal axis is diverted to a slight angle to the longitudinal axis of said pole causing said rotatable pivot means to bind as it rotates on said pole and thus rotate less freely for fewer revolutions after a ball on said ball supporting means has been hit by an improper swing of the bat in an arc whose plane is at a diagonal to the longitudinal axis of said vertically extending pole.

3. A trainer for hitting a baseball as set forth in claim 2, wherein said elongated ball positioning member comprises an elongated shaft having said ball supporting means on said outer end thereof, said elongated shaft having an opposite end, a ball tee member on said opposite end having an upwardly facing surface and a concave recess therein to receive a ball for hitting off of said tee, said body portion of said rotatable pivot means including a laterally extending bore, said elongated shaft being received through said bore and slidable therein to vary the distance each of said ends of said shaft and said ball held on one end and said ball tee on said other end extend outwardly from said vertically extending pole.

4. A trainer for hitting a baseball as set forth in claim 3, wherein said vertically extending pole is made of nylon, said body portion of said rotatable pivot means is made of high density polyethylene, said elongated shaft is made of nylon, and said ball tee member is made of high density polyethylene.

5. A trainer for hitting a baseball, comprising a strike zone indicating assembly including first strike zone indicating means to indicate the lower edge of the strike zone, second strike zone indicating means to indicate the upper edge of the strike zone, third strike zone indicating means to indicate a first side edge of the strike zone, fourth strike zone indicating means to indicate a second opposite side edge of the strike zone, support means to support said strike zone indicating assembly at a location relative to a baseball plate to define the strike zone over said plate, and ball positioning means to position a ball for a batter to swing at and hit anywhere within said strike zone defined by said first, second, third and fourth strike zone indicating means of said strike zone indicating assembly, including first strike zone adjusting means to move said first strike zone indicating means upwardly and downwardly to adjust the strike zone for batters of different heights, and second strike zone adjusting means to move said second strike zone indicating means upwardly and downwardly to further adjust the strike zone for batters of different heights.

6. A trainer for hitting a baseball comprising a strike zone indicating assembly including first strike zone indicating means to indicate the lower edge of the strike zone, second strike zone indicating means to indicate the upper edge of the strike zone, third strike zone indicating means to indicate a first side edge of the strike zone, fourth strike zone indicating means to indicate a second opposite side edge of the strike zone, support means to support said strike zone indicating assembly at a location relative to a baseball plate to define the strike zone over said plate, and bali positioning means to position a ball for a batter to swing at and hit within said strike zone defined by said first, second, third and fourth strike zone indicating means of said strike zone indicating assembly, wherein said support means includes a base member and a cylindrical pole extending upwardly therefrom, said first strike zone indicating means includes a first swivel block member having a longitudinal bore to receive said cylindrical pole therethrough, a first strike zone indicating shaft extending laterally from said first swivel block to indicate the lower edge of the strike zone, said second strike zone indicating means includes a second swivel block member having a longitudinal bore to receive said cylindrical pole therethrough, a second strike zone indicating shaft extending laterally from said second swivel block to indicate the upper edge of the strike zone, said second swivel block member and said second strike zone indicating shaft being located on said cylindrical pole at a spaced apart location above said first swivel block member and said first strike zone indicating shaft.

7. A trainer for hitting a baseball as set forth in claim 6, wherein said first swivel block member includes a laterally extending recess, one end of said first strike zone indicating shaft being received in said laterally extending recess of said first swivel block member, said second swivel block member includes a laterally extending recess, one end of said second strike zone indicating shaft being received in said laterally extending recess of said second swivel block member.

8. A trainer for hitting a baseball as set forth in claim 7, wherein said third strike zone indicating means includes said upwardly extending cylindrical pole and that part of said first and second swivel block members which begins to extend outwardly from said pole in the direction of said first and second strike zone indicating shafts which extend respectively therefrom.

9. A trainer for hitting a baseball as set forth in claim 7, wherein said first strike zone indicating shaft to indicate said lower edge of the strike zone extends from said one end thereof to terminate in an opposite outer end at a distance from said vertically extending pole which corresponds to the width of home plate in the game of baseball.

10. A trainer for hitting a baseball as set forth in claim 9, wherein said opposite outer end of said first strike zone indicating shaft includes an eye-catching member thereon.

11. A trainer for hitting a baseball as set forth in claim 10, wherein said fourth strike zone indicating means includes said outer end of said first strike zone indicating shaft and said eye-catching member thereon.

12. A trainer for hitting a baseball as set forth in claim 10, wherein said eye-catching member on said opposite outer end of said first strike zone indicating shaft includes an enlarged block member made of high density polyethylene.

13. A trainer for hitting a baseball as set forth in claim 7, wherein said second strike zone indicating shaft to indicate said upper edge of the strike zone extends from said one end thereof to terminate in an opposite outer end at a distance from said vertically extending pole which corresponds to substantially one-half the width of home plate in the game of baseball.

14. A trainer for hitting a baseball as set forth in claim 13, wherein said opposite outer end of said second strike zone indicating shaft includes an eye-catching member thereon.

15. A trainer for hitting a baseball as set forth in claim 14, wherein said eye-catching member on said opposite outer end of said second strike zone indicating shaft includes an enlarged block member made of high density polyethylene.

16. A trainer for hitting a baseball as set forth in claim 7, wherein said upwardly extending cylindrical pole is made of nylon, said first and second swivel block members are made of high density polyethylene, said first and second strike zone indicating shafts are made of nylon.

17. A trainer for hitting a baseball as set forth in claim 16, wherein said nylon cylindrical pole, said longitudinal bore of said first high density polyethylene swivel block member and said longitudinal bore of said second high density polyethylene swivel block member have substantially equal diameters for a close fit of said nylon cylindrical pole in said longitudinal bores of said second high density polyethylene swivel block members whereby said swivel block members frictionally hold the position to which they are moved on said cylindrical pole and yet are movable by manually sliding on said nylon pole.

18. A trainer for hitting a baseball as set forth in claim 7, wherein said vertically extending cylindrical pole is disconnectable from and connectable to said base member, said first and second swivel block members are slidable on said cylindrical pole, removable therefrom, and re-positionable thereon, said first and second strike zone indicating shafts are disconnectable from and connectable to their respective first and second swivel block members.

19. A trainer for hitting a baseball as set forth in claim 6, wherein said cylindrical pole, said longitudinal bore of said first swivel block member and said longitudinal bore of said second swivel block member have substantially equal diameters for a close fit of said cylindrical pole in said longitudinal bores of said swivel block members whereby said swivel block members frictionally hold the position to which they are moved on said cylindrical pole and yet are movable by manually sliding on said nylon pole.

* * * * *